US005913383A

United States Patent [19]

Tseng

[11] Patent Number: 5,913,383

[45] Date of Patent: Jun. 22, 1999

[54] FIRE ESCAPE DEVICE FOR LOWERING PEOPLE FROM A HIGH RISE

[76] Inventor: Wen-Tsai Tseng, No. 92, Tong Shun Street, Su Lin Chen, Taipei Hsien, Taiwan

[21] Appl. No.: 09/008,887

[22] Filed: Jan. 20, 1998

[51] Int. Cl.[6] ..... A62B 1/08

[52] U.S. Cl. ..... 182/236; 182/71; 182/73; 182/6; 182/7

[58] Field of Search ..... 182/236, 237, 182/239, 70, 71, 73, 234, 231, 7, 6

[56] References Cited

U.S. PATENT DOCUMENTS

| | | | |
|---|---|---|---|
| 631,968 | 8/1899 | Rees | 182/234 |
| 4,640,388 | 2/1987 | Walborn | 182/239 |

*Primary Examiner*—Alvin Chin-Shue
*Attorney, Agent, or Firm*—Pro-Techtor International Services

[57] ABSTRACT

A fire escape device for lowering people from a high-rise, including a casing having a hanger for hanging on a support in a high-rise from which the user is going to escape, a driving pulley mounted inside the casing, a cable wound round the driving pulley and having an outer end extended out of the casing, a harness adapted for securing the user to the outer end of the cable, a friction disk having a corrugated track, a chain transmission turned by the driving pulley to rotate the friction disk, and spring-supported damping means installed in the casing and pressed on the corrugated track of the friction disk to impart a damping resistance to the driving pulley through the friction disk when the user goes down from the high-rise.

1 Claim, 4 Drawing Sheets

FIRE ESCAPE DEVICE FOR LOWERING PEOPLE FROM A HIGH RISE

BACKGROUND OF THE INVENTION

U.S. patent application Ser. No. 08/768,269 discloses a fire escape device for lowering people from a high-rise. This structure of fire escape device is function, however it still has drawbacks as outlined hereinafter: (1) The damping devices 6 are designed to be mounted in the seats 213;214 at the casing 2, however it is difficult to accurately install the damping devices 6 in a narrow space; (2) The damping devices 6 are respectively forced into contact with the concave surface portions and convex surface portions of the circular track of the friction disk 50, however the damping effect of the damping devices 6 cannot be fully carried out because the friction disk 50 cannot be stably turned in a fixed direction when the user pulls the cable 7.

SUMMARY OF THE INVENTION

The present invention has been accomplished to provide a fire escape device which eliminates the aforesaid drawbacks. It is one object of the present invention to provide a fire escape device which is compact, and can be conveniently fastened to the user's body for lowering the user from a high-rise on fire. It is another object of the present invention to provide a fire escape device which has a simple structure, and is inexpensive to manufacture. It is still another object of the present invention to provide a fire escape device which smoothly buffers the descending speed when a the user is lowered from a high-rise on fire. To achieve these and other objects of the present invention, there is provided a fire escape device which is comprised of a casing having a hanger for hanging on a support in a high-rise from which the user is going to escape, a driving pulley mounted inside the casing, a cable wound round the driving pulley and having an outer end extended out of the casing, a harness adapted for securing the user to the outer end of the cable, a friction disk having a corrugated track, a chain transmission turned by the driving pulley to rotate the friction disk, and spring-supported damping means installed in the casing and pressed on the corrugated track of the friction disk to impart a damping resistance to the driving pulley through the friction disk when the user goes down from the high-rise.

DETAILED DESCRIPTION OF THE PREFERRED EMBODIMENT

Figure 1:
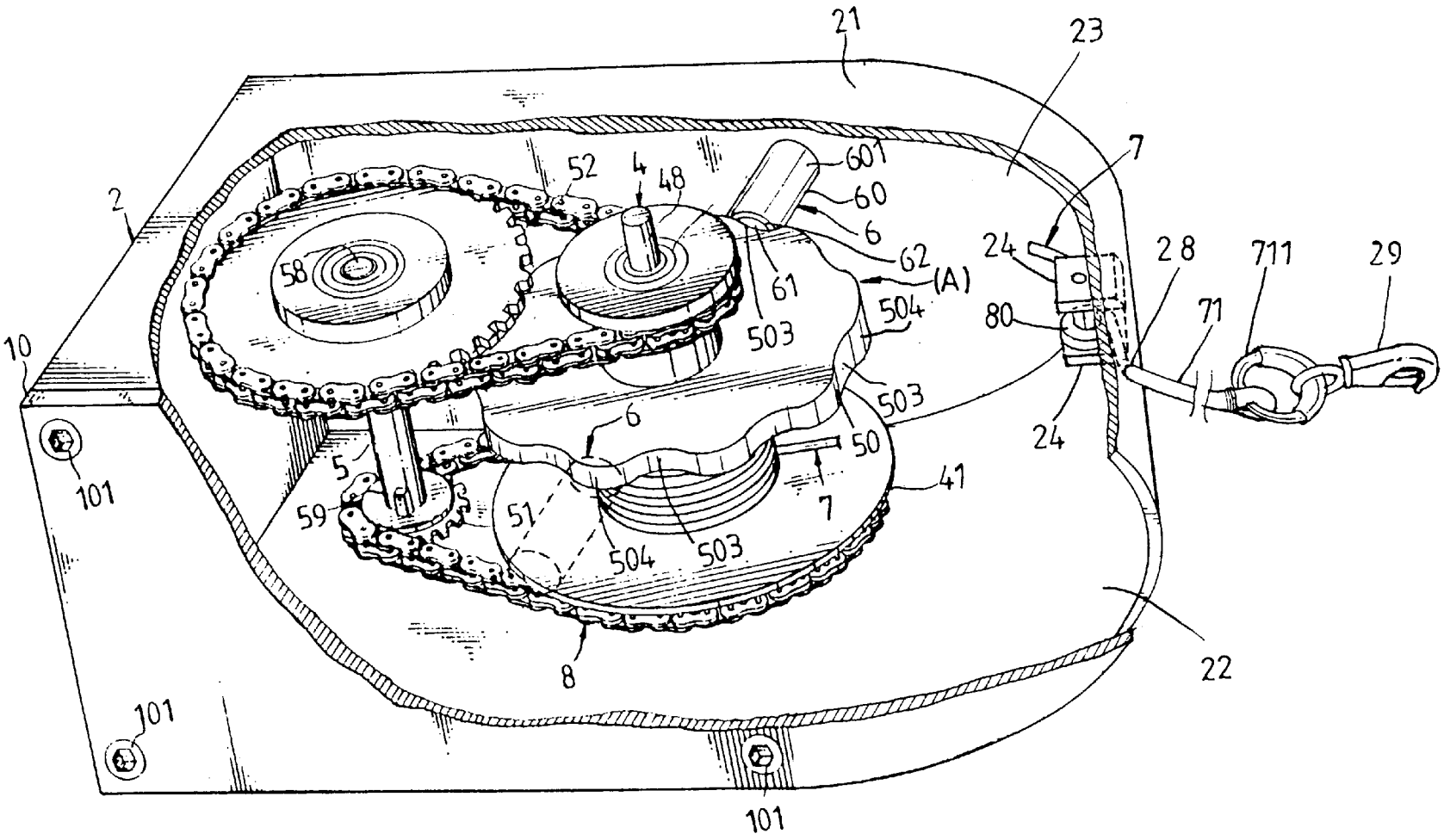
FIG. 1 is a cutaway view of a fire escape device according to the present invention.

Referring to Figures from 1 to 4, a fire escape device in accordance with the present invention is generally comprised of a casing 2, a back cover 10, a harness 3, a driving pulley 41, a driving chain wheel 42, a first shaft 4, a second shaft 5, a first sprocket wheel 51, a driven chain wheel 52, a second sprocket wheel 43, a friction disk 50, two damping devices 6, a cable 7, a first chain 8, and a second chain 9.

Figure 2:
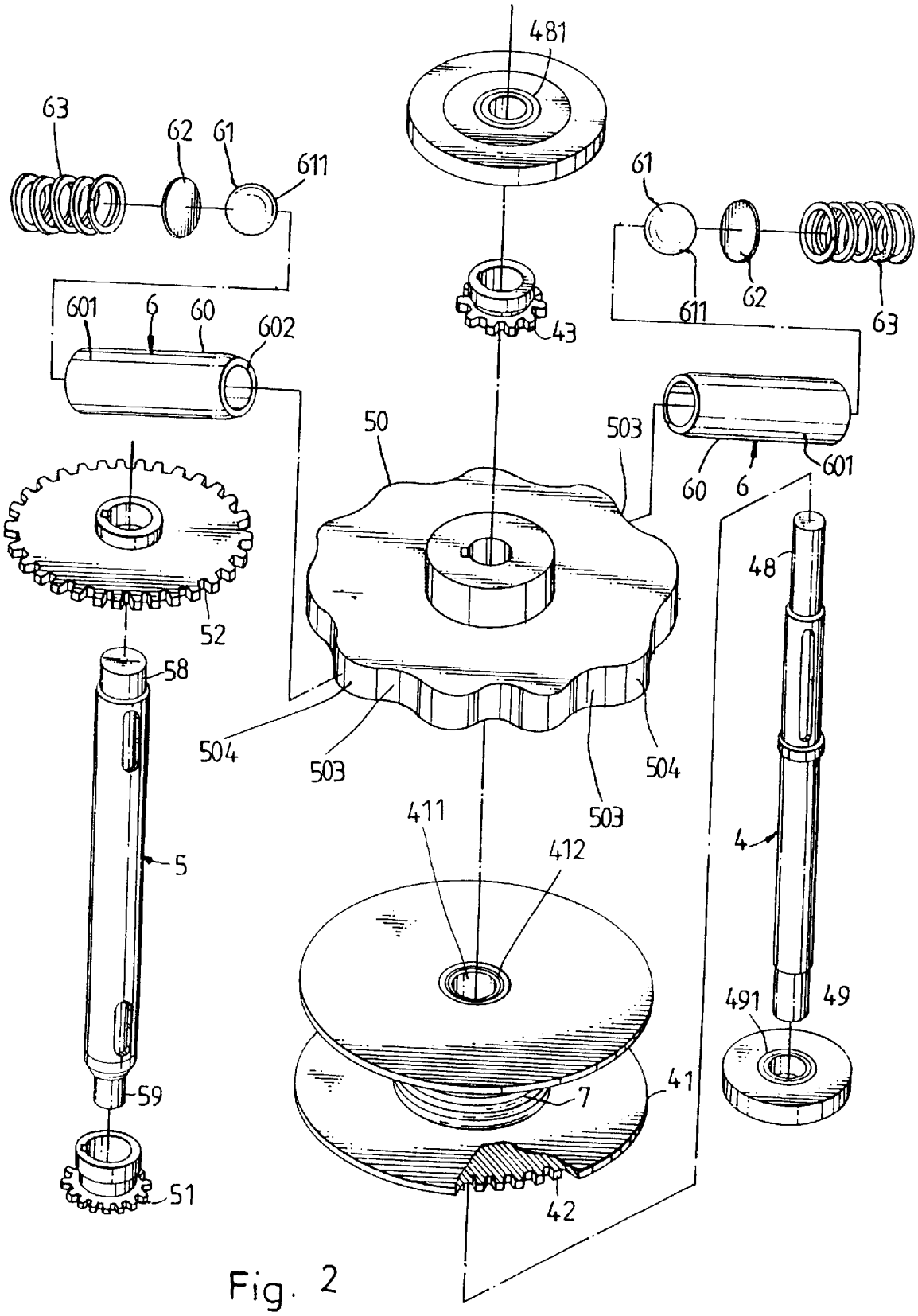
FIG. 2 is an exploded view of a part of the fire escape device shown in FIG. 1.
Figure 3:
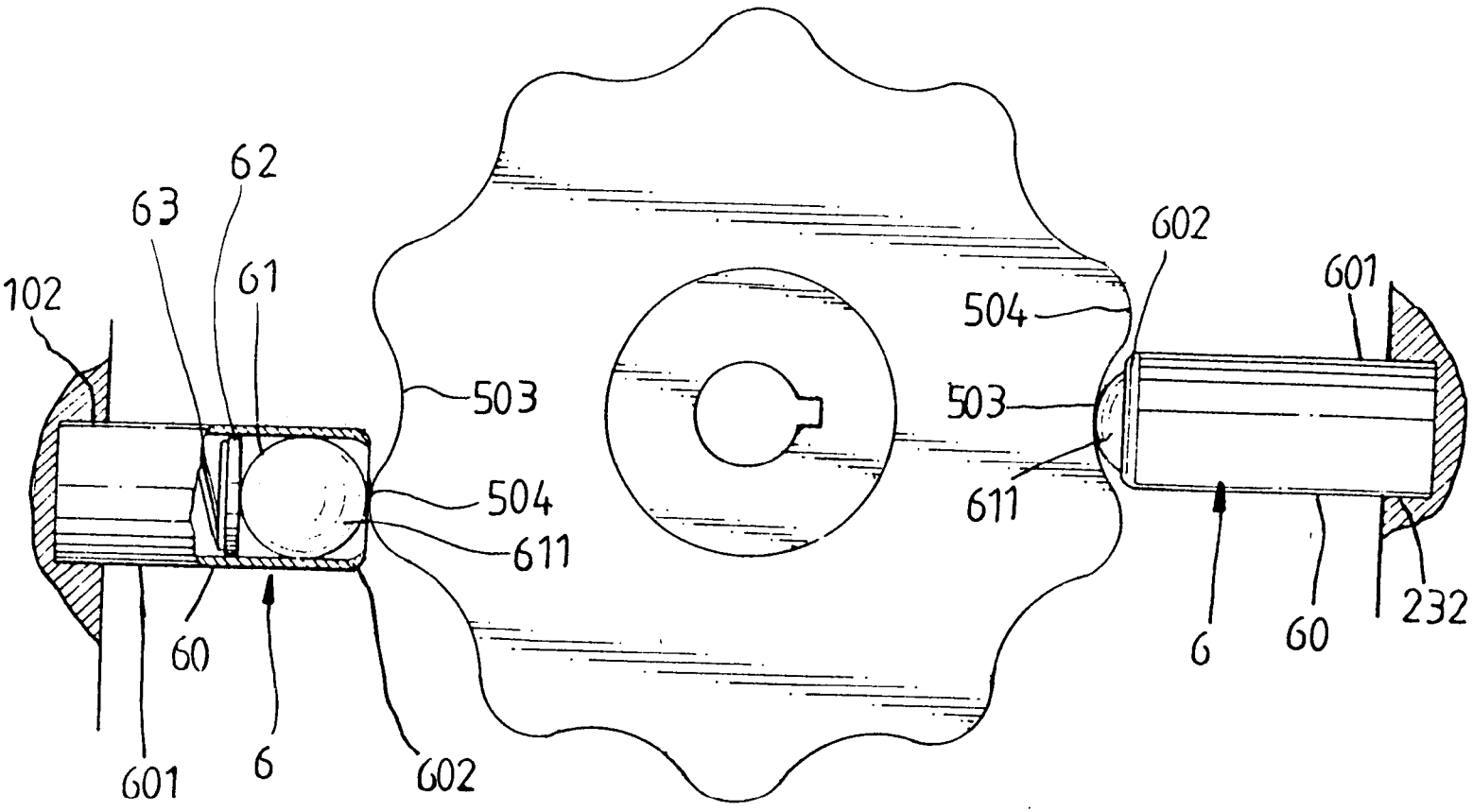
FIG. 3 is a side plain view of a part of the fire escape device shown in FIG. 1; and, FIG. 4 is an applied view of the present invention.
Figure 4:
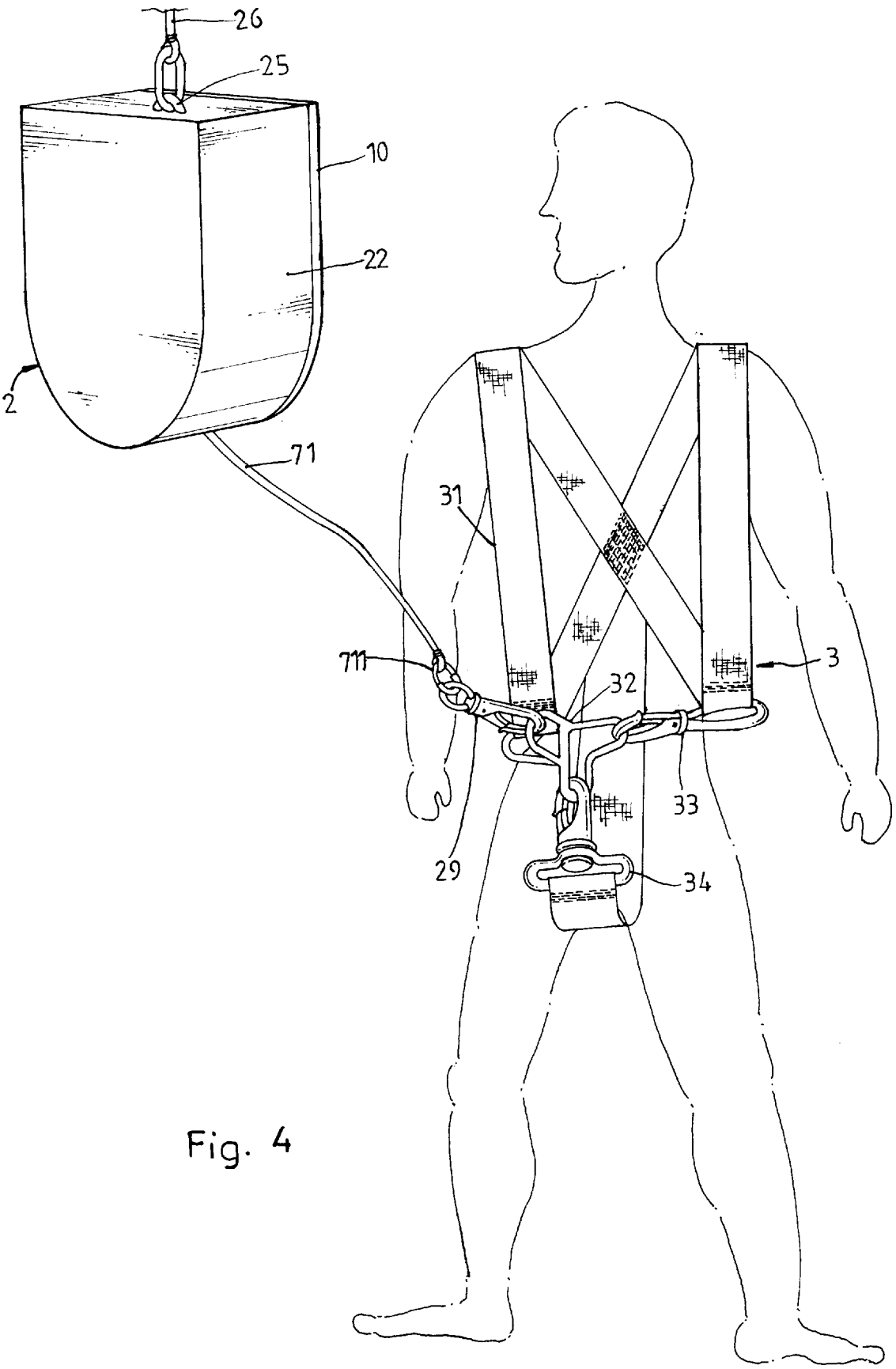

The back cover 10 is fixedly fastened to the back side of the casing 2 by fastening elements 101. The casing 2 is injection-molded from plastic, comprising two parallel locating plates 24 raised from the back of the bottom wall thereof, a guide pulley 80 pivotably mounted between the locating plates 24, and a cable hole 28 adjacent to the locating plates 12. The cable 7 has one end wound round the driving pulley 41 and fixedly connected thereto, and an opposite end 71 wound round the guide pulley 80 and then inserted through the cable hole 28 to the outside of the casing 2 and then fixedly mounted with a ring 711 for coupling to the harness 3 by a swivel 29. The casing 2 further has a first side wall 21, a second side wall 22, a front wall 23. Two seats 232;102 are respective made on the front wall 23 of the casing 2 and the back cover 10, and adapted for holding the damping devices 6. Further, a hanger 25 is fixedly mounted on the casing 2 at the top and adapted for hanging on support means (see FIG. 4). A rope 26 may be fastened to the hanger 25 so that the fire escape device can be secured to a support by the rope 26 (see FIG. 4). The harness 3 is comprised of a strap 31 adapted for fastening to the shoulders and the waist, swivels 33;34 respectively fastened to the strap 31, and a connector link 32 for connecting the swivels 33;34 to the swivel 29 at the ring 711 of the cable 7 (see FIG. 4). The driving pulley 41 comprises an axial axle hole 411, and a bearing 412 mounted in the axial axle hole 411. By means of the bearing 412, the driving pulley 41 is revolvably mounted around the first axle 4 (see FIG. 2). The first axle 4 has two opposite ends 48 and 49 respectively mounted in a respective bearing 481;491. The bearings 481;491 are respectively mounted on the first side wall 21 and second side wall 22 of the casing 2. The second axle 5 has two opposite ends 58 and 59 respectively mounted in the first side wall 21 and second side wall 22 of the casing 2. The first sprocket wheel 51 and the driven chain wheel 52 are respectively mounted around the two opposite ends 59 and 58 of the second axle 5. The driving pulley 41 and the second sprocket wheel 43 are respectively mounted around the two opposite ends 49 and 48 of the first axle 4. The driving chain wheel 42 is fixedly fastened to one side of the driving pulley 41, and turned with it about the first axle 4. The first chain 8 is mounted on the driving chain wheel 42 and the first sprocket wheel 51. The second chain 9 is mounted on the driven chain wheel 52 and the second sprocket wheel 43. The friction disk 50 is mounted around the first axle 4 and turned with the second sprocket wheel 43, having a plurality of concave surface portions 503 and convex surface portions 504 alternatively spaced around the periphery. The concave surface portions 503 and the convex surface portions 504 form a track. The damping devices 6 are respectively mounted in the casing 2, and adapted for imparting a damping resistance to the friction disk 50. Each damping device 6 comprises a barrel 60 having a first end 601 fastened to the seat 232 of the front wall 23 of the casing 2 or the seat 102 of the back cover 10 and a second end 602 facing the friction disk 50, a compression spring 63 mounted inside the barrel 60, a steel ball 61 mounted in the barrel 60 and forced by the compression spring 63 out of the second end 602 of the barrel 60 into contact with the track 503;504 of the friction disk 50, and a cushion 62 mounted within the barrel 60 and retained between the compression spring 63 and the steel ball 61 (see FIGS. 2 and 3). When the friction disk 50 is rotated, the steel balls 61 are moved in the track 503; 504 of the friction disk 50. When the steel balls 61 are moved to the concave surface portions 503, less damping resistance is imparted to the friction disk 50, and the friction disk 50 can be turned at a relatively higher speed; on the contrary when the steel balls 61 are moved to the convex surface portions 504, much damping resistance is imparted to the friction disk 50, and the revolving speed of the friction disk 50 is relatively reduced.

When in use, the casing 2 is hung on a support by the hanger 25 or the rope 26, and the harness 3 is fastened to the user's body and secured to the cable 7, and the user can then come down from the high-rise on fire. When the user descends, the cable 7 is pulled out of the casing 2, and at the same time the driving pulley 41 is driven by the cable 7 to turn the first sprocket wheel 51 through the first chain 8. When the first sprocket wheel 51 is rotated, the driven chain wheel 52 is synchronously rotated, thereby causing the second sprocket wheel 43 to be turned by the second chain 9. When the second sprocket wheel 43 is rotated, the friction disk 50 is synchronously turned, causing the steel balls 61 of the damping devices 6 to move over the concave surface portions 503 and convex surface portions 504 of the friction disk 50 (see FIG. 3), therefore the descending speed of the user is intermittently buffered.

Further, the number of teeth of the driving chain wheel 42 as well as that of the driven chain wheel 52 are 30, and the number of teeth of the first sprocket wheel 51 as well as that of the second sprocket wheel 43 are 12. Therefore, when the driving chain wheel 42 is turned with the driving pulley 41, the friction disk 50 receives resisting force from the periphery 611 of the steel balls 61 of the damping devices 6 125 times (10×2×6.25) per each run.

While only one embodiment of the present invention has been shown and described, it will be understood that various modifications and changes could be made thereunto without departing from the spirit and scope of the invention disclosed.

What the inventor claimed is:

1. A fire escape device for lowering people from a high-rise, comprising:

a casing injection molded from plastic, said casing comprising a first side wall, a second side wall, a front wall, a bottom wall, a top wall, a back opening, a back cover covered on said back opening, two seats respectively made on said front wall and said back cover and adapted for holding two damping devices, a hanger fixedly mounted on said top wall on the outside and adapted for hanging said casing on a support, two parallel locating plates raised from said bottom wall on the inside, a guide pulley pivotably mounted between said locating plates, and a cable hole formed in said bottom wall adjacent to said locating plates;

a first axle having two opposite ends respectively supported on a respective bearing installed in the first side wall and second side wall of said casing;

a second axle having two opposite ends respectively mounted in the first side wall and second side wall of said casing;

a driving pulley mounted around said first axle;

a cable having one end wound round said driving pulley and fixedly connected thereto, and an opposite end wound round said guide pulley and then inserted through the cable hole of said casing and terminating in a hanging ring outside said casing;

a harness adapted for securing to the user's body to said cable, said harness comprising a plurality of swivels, a connector link fastened to said swivels and adapted for securing to the hanging ring of said cable;

a first sprocket wheel and a driven chain wheel respectively mounted around the two opposite ends of said second axle;

a driving pulley and a second sprocket wheel respectively mounted around the two opposite ends of said first axle, said driving pulley being fixedly fastened to one side of said driving chain wheel and turned with it about said first axle;

a first chain mounted on said driving chain wheel and said first sprocket wheel;

a second chain mounted on said driven chain wheel and said second sprocket wheel;

a friction disk mounted around said first axle and turned with said second sprocket wheel, having a circular track at one side, said circular track comprised of a plurality of concave surface portions and convex surface portions alternatively arranged together; and two damping devices respectively mounted in said casing and adapted for imparting a damping resistance to said friction disk, each of said damping devices comprising a barrel having a first end fastened to one seat of the first side wall of said casing and a second end facing said friction disk, a compression spring mounted inside said barrel, a steel ball mounted in said barrel and forced by said compression spring out of the second end of said barrel into contact with the track of said friction disk so as to impart a damping resistance to said friction disk when said friction disk is turned with said second sprocket, and a packing piece mounted within said barrel between said compression spring and said steel ball.

* * * * *